US005732513A

United States Patent [19]

Alley

[11] Patent Number: 5,732,513

[45] Date of Patent: Mar. 31, 1998

[54] SNOW GUARD FOR A METAL ROOF

[76] Inventor: F. William Alley, Edson Hill Rd., Stowe, Vt. 05672

[21] Appl. No.: 760,667

[22] Filed: Dec. 9, 1996

Related U.S. Application Data

[62] Division of Ser. No. 391,726, Feb. 21, 1995, Pat. No. 5,613,328.

[51] Int. Cl.[6] ..... E04D 13/10

[52] U.S. Cl. ..... 52/25; 52/24; 52/26; 411/432; 411/9.7

[58] Field of Search ..... 52/24, 25, 26; 411/432, 9.7

[56] References Cited

U.S. PATENT DOCUMENTS

| | | | |
|---|---|---|---|
| 473,512 | 4/1892 | Laird | 52/25 |
| 4,927,305 | 5/1990 | Peterson, Jr. | 411/432 X |
| 5,228,248 | 7/1993 | Haddock | 52/25 |
| 5,483,772 | 1/1996 | Haddock | 52/25 |
| 5,613,328 | 3/1997 | Alley | 52/25 |

FOREIGN PATENT DOCUMENTS

| | | | |
|---|---|---|---|
| 3716491 | 12/1988 | Germany | 52/24 |
| 3723020 | 1/1989 | Germany | 52/24 |
| 204783 | 1/1939 | Switzerland | 52/24 |

*Primary Examiner*—Carl D. Friedman
*Assistant Examiner*—W. Glenn Edwards
*Attorney, Agent, or Firm*—Clifford L. Tager

[57] ABSTRACT

The present invention is directed to a device capable of being attached to a metal roof comprises a substantially perpendicular seam. The device comprises a block. A groove is located in the base of the block, and the block is locatable on the roof by placement of the groove on the seam. There are two embodiments for securing the block to the seam. In the first embodiment, a threaded hole is located in the block between the first side wall and the groove, and a cavity is located in the groove diametrical to the threaded hole. A set screw is locatable in the threaded hole. The set screw has an opening at its terminal end for receiving an element having a curved surface, the element protruding therefrom and pivotable therewithin. Driving the set screw into the hole causes the curved surface of the element to engage the seam, driving the seam towards the cavity of the groove diametric thereto, thereby forming a pocket in the seam, and securing the block to the seam. In the second embodiment, a chamber is located in the base of the block. A cam is pivotally mounted within the chamber and translocatable within the groove. A cavity is located in the groove opposite the cam. Sliding the block along the seam causes the cam to engage the seam, driving the seam towards the cavity, thereby forming a pocket in the seam. Both embodiments secure the block to the roof without piercing or tearing the seam.

9 Claims, 6 Drawing Sheets

FIG. 6
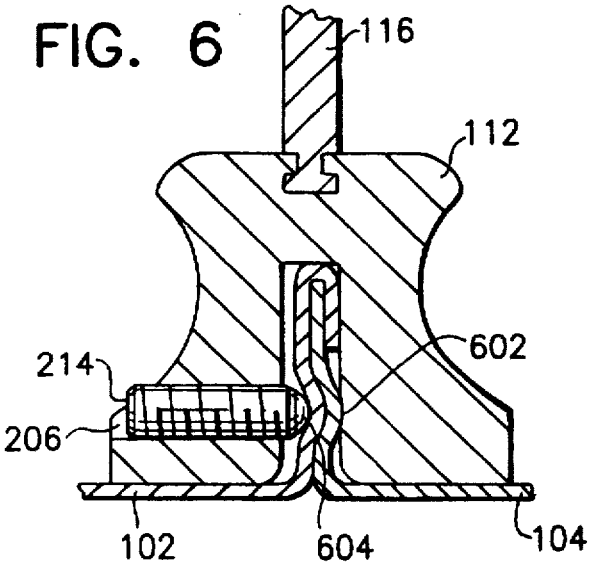
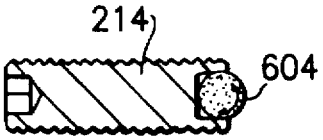
FIG. 7
FIG. 2
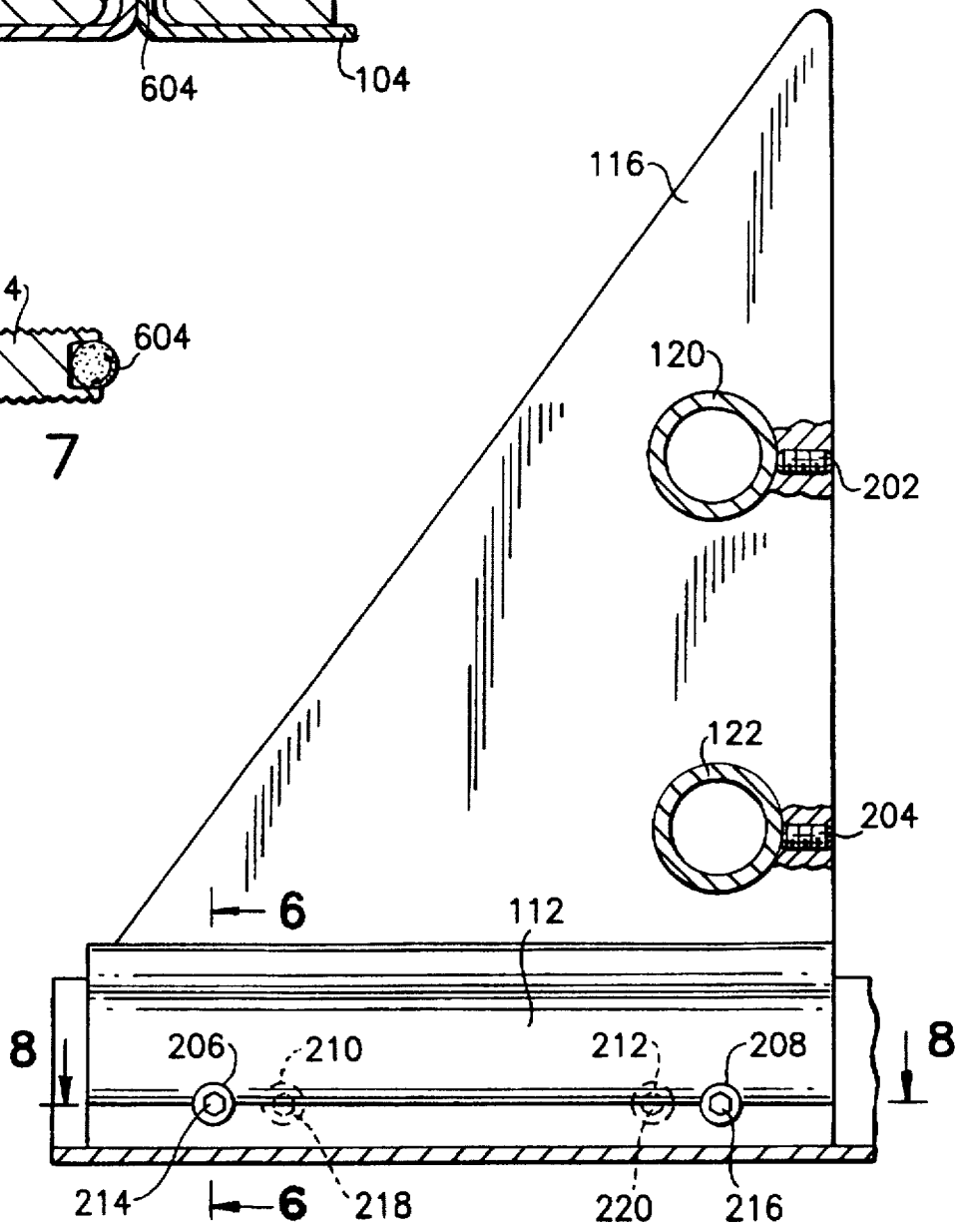

SNOW GUARD FOR A METAL ROOF

This application is a division of application Ser. No. 08/391,726, filed 21 Feb. 1995, now U.S. Pat. No. 5,613,328.

BACKGROUND OF THE INVENTION

1. Technical Field

The present invention is directed to a device capable of being attached to a roof. More particularly, the present invention is directed to a device capable of being attached to a metal roof, wherein the attachment thereto is done without tearing, puncturing or otherwise destroying the hermeticity of the metal roof.

2. Background Information

Metal roofs are well known in the art and can be found on many types of commercial buildings. Metal roofs are typically placed over a plywood or particle board substructure.

A typical metal roof comprises a plurality of metal roofing panels. Each panel has a longitudinal length to cover the span of the roof section, and the panels are laid side by side to cover the width of a roof section.

Each panel preferably includes substantially perpendicular edges running along both the left and right sides thereof, and the roofing panels are located such that their substantially perpendicular edges are abutting, thereby forming a seam therebetween.

The substantially perpendicular edges of the abutting panels are each typically crimped together and/or bent downwardly over each other to form a joint. The joint seals the adjoining panels, thereby preventing fluid communication to the roofing substructure below the roofing panels, as well as to the area between each roofing panel. Fluid communication to the substructure could lead to the substructure becoming rotted, infested or otherwise loosing or degrading its structural integrity.

Various metal roof installers have devised unique patterns for the joints, ostensibly to prevent the migration of moisture from the exterior surface of the roofing panels to the interior surface thereof via the roofing panel abutment point.

It is often desirable to secure a useful device to the metal roof. For example, a snow guard is useful to prevent snow and ice from falling off the metal roof, thereby potentially damaging persons and property located in the fall path. Additionally, scaffolding may be useful to assist with work being performed on or near the roof of the building.

A useful device can be attached either to a roofing panel of the metal roof or to the seam of the abutting roofing panels. One possible attachment method is via screws or bolts. However, both screws and bolts puncture the roofing panel or seam where they are driven therethrough, thereby destroying the hermeticity of the metal roof.

While the useful device is in place, there is a possibility of fluid communication through the holes created by the screws or bolts. After the useful device is removed, the holes left thereby would have to be patched, with possible periodic maintenance to insure the integrity of the patch job.

Another possible attachment method is via a set screw. Specifically, the useful device comprises a groove, a threaded hole from one side of the useful device to the groove, and an indented portion located in the groove opposite the hole. The set screw typically has a blunt end.

The useful device is placed over the seam of the metal roof and the set screw is threaded through the hole. As the set screw is driven into the threaded hole, the blunt end of the set screw contacts a portion of the seam. Further driving the set screw into the hole causes the portion of the seam which is in contact with the blunt end of the set screw to be driven towards and into the indented portion located in the groove opposite the set screw hole. Bending the seam in this fashion secures the useful device onto the seam.

Unfortunately, however, the set screw also tends to tear the seam at the point where the blunt end of the set screw contacts the seam. Specifically, as the blunt end of the set screw is driven further into the hole and contacts the seam, friction is created between the blunt end of the turning set screw and the seam in forced contact therewith. The friction causes the rotational torque imparted to the blunt end as a result of driving the set screw further into the hole to be transferred to the seam. The transferred rotational torque and friction fatigues the seam, causing it to be turned in the same direction as the set screw, thereby producing tears in the seam at the set screw/seam interface.

The tears in the seam degrade the hermeticity of the metal roof, leading to possible fluid communication therethrough with all of the deleterious consequences as stated above.

SUMMARY OF THE INVENTION

Accordingly, the present invention is directed to a device capable of being attached to a metal roof, wherein the attachment of the device to the metal roof is done without tearing, puncturing or otherwise destroying the hermeticity of the metal roof.

The metal roof comprises a first roofing panel and a second roofing panel, the first and second roofing panels each having a substantially perpendicular longitudinal edge thereon. The roofing panels are positioned such that the longitudinal edge of the first roofing panel is in close proximity to the longitudinal edge of the second roofing panel, thereby forming a seam therealong.

In the preferred embodiment, the device comprises a block having a first and a second side wall, a base and a top. A groove is located in the base of the block, and the block is locatable on the metal roof by placement of the groove about a segment of the seam.

The present invention presents two distinct embodiments for securing the block to the seam of the metal roof without tearing, puncturing or otherwise destroying the hermeticity of the metal roof.

In the first embodiment, a first threaded hole is located in the block between the first side wall and the groove, a first cavity is located in the groove diametrical to the first threaded hole, and the device further comprises a first element having a substantially curved surface and a first set screw locatable in the first threaded hole.

The first set screw has an opening at its first terminal end for receiving the first element such that the curved surface of the first element protrudes therefrom and is pivotable therewithin. The first set screw further has a second terminal end drivable into the first threaded hole.

By locating the device of the present invention on the metal roof via placing the groove about a segment of the seam and by driving the first set screw into the first threaded hole, the substantially curved surface of the first element engages a first portion of the seam of the metal roof. The friction between the curved surface of the first element and the first engaged portion of the seam precludes any rotational movement therebetween, since the first element is pivotable within the first set screw.

Further driving the first set screw causes the first engaged portion of the seam to be driven towards the first cavity of the groove diametric thereto, thereby forming a pocket in the first engaged portion of the seam. Bending the seam in this fashion secures the device to the seam.

Since the curved surface of the first element does not transfer any rotational torque to the first engaged portion of the seam, the first element does not produce any tears in the seam, thus preserving the hermeticity of the metal roof.

In the second embodiment, a chamber is located in the base of the block, the chamber having a portion thereof in juxtaposition with a portion of the groove. A first terminal end of a cam is pivotally mounted within the chamber, and a second terminal end of the cam is locatable within the groove and translocatable therewithin. A first cavity is located in the groove in a position substantially opposite the cam.

By locating the device on the metal roof via placing the groove about a segment of the seam and sliding the block along the seam, the second terminal end of the cam engages a first portion of the seam. Further sliding the block along the seam causes the cam to be driven towards the first cavity, causing the first engaged portion of the seam to also be driven towards the first cavity, thereby forming a pocket in the first engaged portion of the seam. Bending the seam in this fashion secures the device to the seam.

Optionally, a threaded hole is located in the block between one of the side walls and the chamber, and a set screw is locatable in the threaded hole. Driving the set screw into the threaded hole causes the cam to travel in a direction towards a first engaged portion of the seam and precludes the cam from traveling in a direction opposite thereto.

Alternatively, rather than sliding the block along the seam to engage the cam, the set screw can be driven into the hole, forcing the second terminal end of the cam to travel in a first direction and ultimately to engage a first portion of the seam. Further driving the set screw into the hole causes the first engaged portion of the seam to be driven towards the first cavity, thereby forming a pocket in the second engaged portion of the seam.

The first and second embodiments for securing the block to the metal roof can be used either independently or in combination.

BRIEF DESCRIPTION OF THE DRAWINGS

FIG. 2 is a cross-sectional view taken along lines 2—2 of FIG. 1.

FIG. 6 is a cross-sectional view taken along lines 6—6 of FIG. 2.

FIG. 7 is a cross-sectional view of the preferred embodiment of the set screw configuration shown in FIG. 6.

DESCRIPTION OF THE PREFERRED EMBODIMENT(S)

Figure 1:
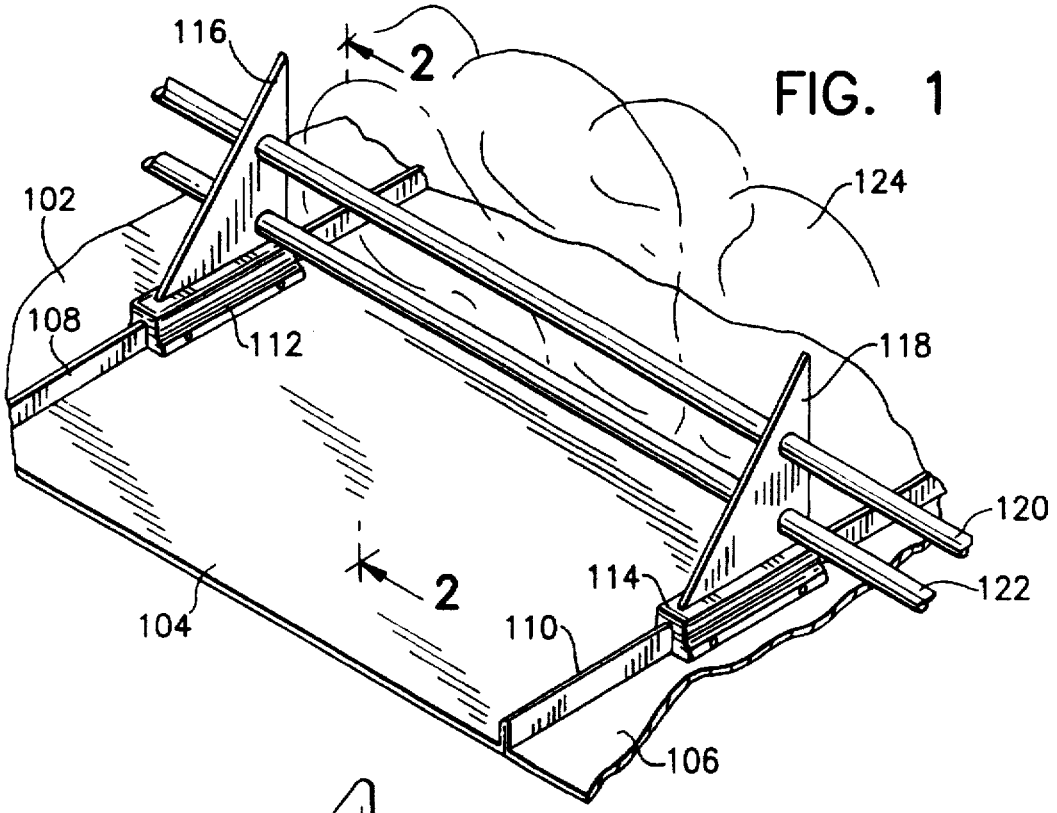
FIG. 1 is an orthogonal view of the present invention used in conjunction with a snow guard.

Turning now to FIG. 1, an orthogonal view of the present invention used in conjunction with a snow guard mounted on a metal roof is illustrated.

The metal roof comprises a plurality of metal roofing panels, such as 102, 104 and 106. The longitudinal length of each panel preferably is contiguous to cover the span of the roof section. A plurality of roofing panels are laid side by side to cover the width of a roof section.

Each panel preferably includes substantially perpendicular edges running along both the left and right sides thereof, and the roofing panels are located such that their substantially perpendicular edges are abutting, thereby forming a seam therebetween.

The substantially perpendicular edges of the abutting panels are each typically crimped together and/or bent downwardly over each other to form a joint, such as 108 and 110. The joint seals the adjoining panels, thereby preventing fluid communication to the roofing substructure below the roofing panels, as well as to the area between each roofing panel. Fluid communication to the substructure could lead to the substructure becoming rotted, infested or otherwise loosing or degrading its structural integrity.

The snow guard comprises blocks 112 and 114, each having a groove, or other suitable opening, located in the base thereof. The blocks are locatable on the metal roof by placing the groove about a segment of the seam. Each block further has a groove, or other suitable opening, located in the top thereof, into which brackets 116 and 118 are placed.

Brackets 116 and 118 have a plurality of holes located therein, allowing pipes 120 and 122 to be placed therethrough. The pipes preferably help to secure snow 124 which might accumulate on the roof, thereby preventing it from falling off the roof and potentially damaging persons and property located in its fall path.

A cross-sectional view of FIG. 1, taken along lines 2—2, is illustrated with reference to FIG. 2, which shows pipes 120 and 122 secured in bracket 116 via set screws 202 and 204, respectively.

Figure 3:
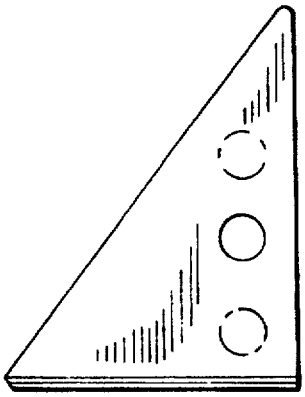
FIG. 3 is a side view of an alternative embodiment of the bracket shown in FIG. 1 for use with a snow guard.

Brackets 116 and 118 are shown in FIG. 1 with two holes therein to accommodate two pipes. The brackets could alternatively have any other number of holes to accommodate more or less pipes. For example, as shown with reference to FIG. 3, the bracket could have one, two or three holes to accommodate the same number of pipes therein.

Figure 4:
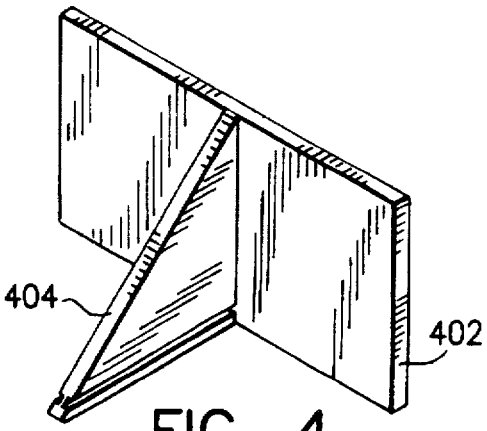
FIG. 4 is an orthogonal view of an alternative embodiment of the bracket shown in FIG. 1 for use with scaffolding.

The brackets could alternatively be configured to provide various other uses. For example, as shown with reference to FIG. 4, the bracket could comprise plate 402 perpendicularly mounted to plate 404. Boards (not shown) could thus be supported by plates 402, thereby allowing scaffolding to be erected to assist with work being performed on or near the roof of the building.

Figure 5:
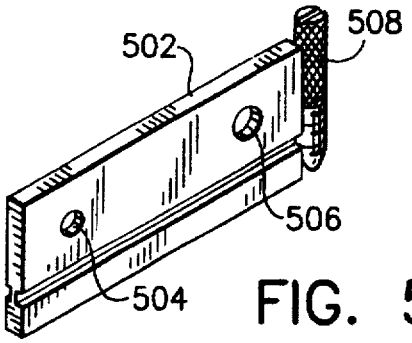
FIG. 5 is an orthogonal view of an alternative embodiment of the bracket shown in FIG. 1 for use with a safety rope.

Alternatively, as shown with reference to FIG. 5, the bracket could comprise plate 502 having a plurality of various sized holes 504 and 506 into which safety ropes can be attached, preferably via a caribeener (not shown). Screw 508 is preferably placed in a correspondingly-receptive hole (not shown) in the block to prevent plate 502 from sliding out of the groove in which plate 502 is located.

Returning now to FIG. 2, one embodiment for securing block 112 to the metal roof without tearing, puncturing or otherwise destroying the hermeticity of the metal roof is illustrated. Block 112 preferably comprises four holes, holes 206 and 208 located on one side, and holes 210 and 212 located on the other side thereof.

Holes 206–212 are preferably threaded holes into which set screws 214–220 are respectively driven so as to contact the seam of the metal roof and thereby secure the block thereto.

While the present invention is discussed with reference to securing the block to a portion of the seam, it will be appreciated that the block can alternatively be secured to a portion of the joint A cross-sectional view of block 112, taken along lines 6—6, is illustrated with reference to FIG. 6. As shown in FIG. 6, the substantially perpendicular edge of roofing panel 102 is adjacent the substantially perpendicular edge of roofing panel 104, thereby forming a seam therealong, with the top portions thereof folded over to prevent fluid communication to the roofing substructure below the roofing panels, as well as to the area between each roofing panel.

Set screw 214 is preferably driven into threaded hole 206 and contacts a portion of the seam. Further driving set screw 214 into hole 206 causes the seam to bend, or dimple, into cavity 602, located diametric thereto.

To prevent the torque applied to the set screw from being transferred to the seam, thereby potentially causing the seam to tear or otherwise fatigue, the set screw preferably comprises element 604, located in the set screw. Element 604 preferably has a substantially curved surface to contact the seam, and has a portion which is pivotally located within the terminal portion of set screw 214.

By driving set screw 214 into threaded hole 206, the substantially curved surface of element 604 engages a portion of the seam of the metal roof. The friction between the curved surface of element 604 and the engaged portion of the seam precludes any rotational movement therebetween, since clement 604 is pivotable within set screw 214.

Further driving set screw 214 into threaded hole 206 causes the engaged portion of the seam to be driven towards cavity 602 located in the groove diametric thereto, thereby forming a pocket in the engaged portion of the seam.

Since the curved surface of element 604 does not transfer any rotational torque to the engaged portion of the seam, element 604 does not produce any tears in the seam, thus preserving the hermeticity of the metal roof.

A cross-sectional view of set screw 214 and element 604 is shown with reference to FIG. 7. In the preferred embodiment, set screw 214 comprises a hole located at the terminal end thereof into which element 604 is locatable. Element 604 is preferably a ball bearing which protrudes about 40% therefrom.

A drop of wax (not shown) is preferably placed in the hole of the set screw to secure the ball beating therein, to keep the ball bearing localized. As the set screw is driven into its threaded hole, the friction between the portion of the seam engaged by the ball bearing and the ball bearing will break the wax bond between the ball bearing and the set screw.

In an alternative embodiment, element 604 can be any suitable shape and size. For example, element 604 could have a convex surface whose width is greater than its height, with a shaft located in the back thereof to be placed in the hole located at the terminal end of the set screw.

Figure 8:
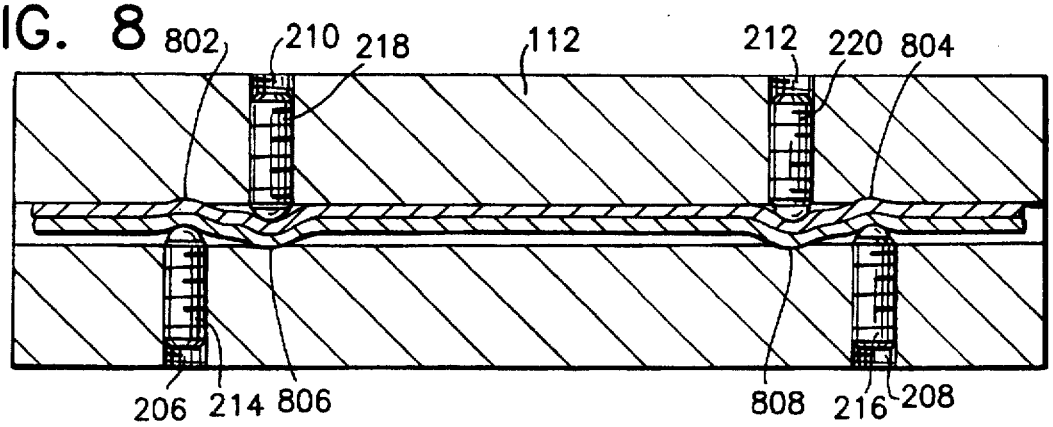
FIG. 8 is a cross-sectional view taken along lines 8—8 of FIG. 2.

A cross-sectional view of the block, taken along lines 8—8 shown in FIG. 2, is shown with reference to FIG. 8, which illustrates the four set screws (214–220) fully driven into their respective threaded holes (206–212). In the preferred embodiment, four cavities (802–808) are located within the groove of the base of the block in a position diametric to each of the four threaded holes (206–212), enabling the four set screws (214–220) and ball bearings contained therein to dimple the seam as shown.

Bending the seam in this fashion securely mounts the block to the seam of the metal roof. Because the seam is bent, the block cannot slip, either horizontally or vertically, from the seam.

Figure 9:
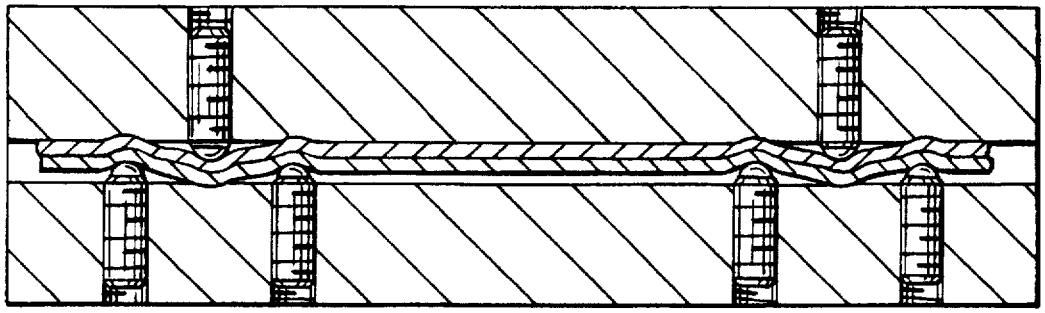
FIG. 9 is a cross-sectional view illustrating an alternative configuration of the set screw configuration shown in FIG. 8.

It will be appreciated that the block could alternatively be configured to include any number of set screw/ball bearing configuration patterns. For example, as shown with reference to FIG. 9, two sets of three set screw/ball bearing configurations can be employed. Where more than one set screw/ball bearing configuration is employed, it is preferred that they are located offset from and opposed to each other, so that the seam of the metal roof is bent in an "s"-curve shape. The localized dimple, or pocket, formed by the set screw/ball bearing configuration, in conjunction with the s-curve bend in the seam, insure a secure mounting of the block to the seam of the metal roof.

Turning now to FIGS. 10 through 13, a second embodiment for securing block 112 to the metal roof without tearing, puncturing or otherwise destroying the hermeticity of the metal roof is illustrated.

Figure 10:
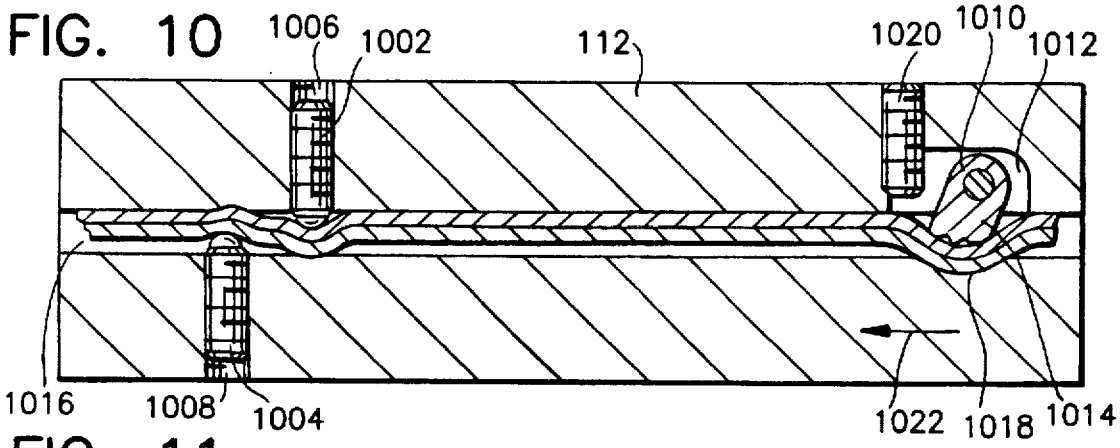
FIG. 10 is a cross-sectional view illustrating a cam configuration used in conjunction with the set screw configuration of FIG. 8.

As shown in FIG. 10, in addition to set screw/ball bearing configurations 1002 and 1004 located in threaded holes 1006 and 1008, respectively, block 112 comprises cam 1010 pivotally mounted within chamber 1012 such that terminal end 1014 of cam 1010 is locatable within groove 1016 of the base of block 112 and translocatable therewithin. Cavity 1018 is preferably located in groove 1016 in a position substantially opposite cam 1010.

To secure block 112 to the seam of the metal roof via the cam, set screw 1020 is preferably turned out of its threaded hole at least until the terminal end thereof is not located within cavity 1012, thereby allowing terminal end 1014 of the cam to fully reside within cavity 1012. Groove 1016 of the block is placed about a segment of the seam of the metal roof.

There are two preferred methods of securing the block to the seam of the metal roof via the cam. In the first method, the block is slid along the seam, preferably in the direction shown by arrow 1022, causing terminal end 1014 of the cam to engage a portion of the seam. Further sliding the block in this direction causes terminal end 1014 of the cam to be driven towards cavity 1018, causing the engaged portion of the seam to also be driven theretowards, thereby forming a pocket in the engaged portion of the seam and bending the seam as illustrated. Set screw 1020 can thereafter be driven into cavity 1012, thereby securing the cam, and thus the block, in place.

In the second method, rather than sliding the block along the seam to engage the cam, set screw 1020 is driven into its threaded hole and into cavity 1012, eventually contacting the cam and driving terminal end 1014 thereof towards cavity 1018, ultimately causing terminal end 1014 of the cam to engage a portion of the seam. Further driving set screw 1020 into cavity 1012 causes the engaged portion of the seam to also be driven towards cavity 1018, thereby forming a pocket in the engaged portion of the seam and causing the seam to bend as illustrated.

In the preferred embodiment, terminal end 1014 of the cam comprises a substantially curved surface. Additionally, to assist the terminal end in engaging the seam of the metal roof, terminal end 1014 of the cam preferably comprises multiple grooves in the curved surface which act as teeth to engage the seam.

After the cam has been locked in place, as described above, set screw/ball bearing configurations 1002 and 1004 can be driven into their threaded holes 1006 and 1008, respectively, forming localized dimples, or pockets, in the seam and causing the seam to bend in an s-shape, as discussed above.

The pockets formed in the seam by the set screw/ball bearing configurations and by the cam, as well as the s-curve bends in the seam caused thereby, insures a secure mounting of the block to the seam of the metal roof.

The set screw/ball bearing configuration and the cam configuration can be used either independently or in combination. For example, a second cam configuration can be located on the block, either in addition to or in place of the two set screw/ball bearing configurations illustrated in FIG. 10. Where a second cam configuration is employed, it is preferably that the cam configuration is located on the other side of the groove, i.e., a mirror-image of the first cam configuration.

It will be appreciated that the block could alternatively be configured to include any number of set screw/ball bearing configurations in conjunction with the cam configuration(s). For example, as shown with reference to FIG. 11, one screw/ball bearing configuration can be employed therewith.

Figure 12:
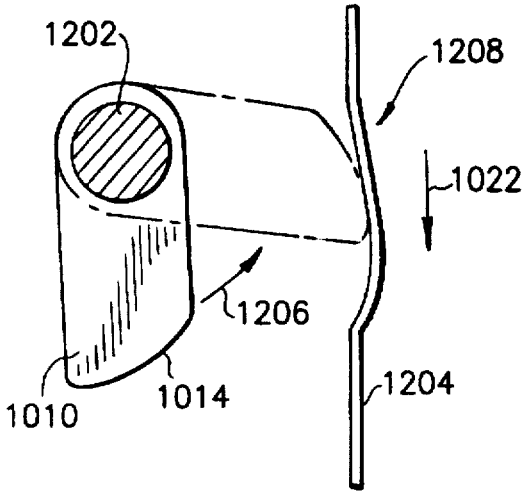
FIG. 12 is a worm's eye view illustrating the principles of the cam configuration shown in FIG. 10.

Turning now to FIG. 12, a worm's eye view of the cam configuration of FIG. 10 is illustrated for discussing the principles of the cam. Cam 1010 is preferably pivotally mounted in its cavity by bolt 1202, the terminal end of which is threaded into the block. As will be appreciated, as the block moves in the direction of arrow 1022, terminal end 1014 of cam 1010 contacts a portion of seam 1204, causing the terminal end of the cam to move in the direction of arrow 1206, thereby bending the seam, as shown at 1208, into the cavity (not shown).

Figure 11:
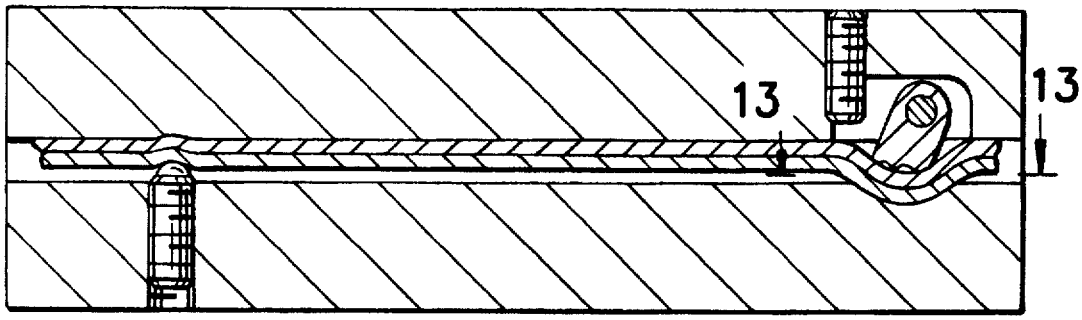
FIG. 11 is a cross-sectional view illustrating the cam configuration of FIG. 10 used in conjunction with an alternative set screw configuration.
Figure 13:
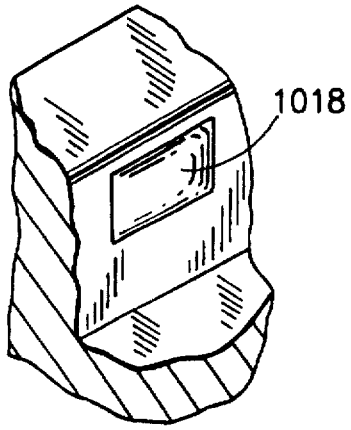
FIG. 13 is a cross-sectional view taken along lines 13—13 of FIG. 11.

FIG. 13 is a cross-sectional view taken along lines 13—13 of FIG. 11, illustrating cavity 1018 into which the terminal end of the cam drives the engaged portion of the seam of the metal roof.

As discussed above with reference to FIG. 1, the metal roof comprises a plurality of metal roofing panels, each having substantially perpendicular edges running along both the left and right sides thereof. The roofing panels are located such that their substantially perpendicular edges are abutted to form a seam. The top portions of the abutted roofing panels are typically crimped together and/or bent downwardly over each other to form a joint, e.g., as shown with reference to FIG. 6.

Often, the width of the joint is substantially wider than the width of the seam. To accommodate this situation, the width of the groove which is placed thereover (located in the base of the block) is preferably increased. The length of the set screws which secure the block to the seam is also preferably increased to compensate for the increased distance between the side walls of the block and the seam.

In the preferred embodiment, a filler material is located in the groove of the block between one side of the seam/joint and the corresponding side of the block to fill in the space therebetween.

Figure 14:
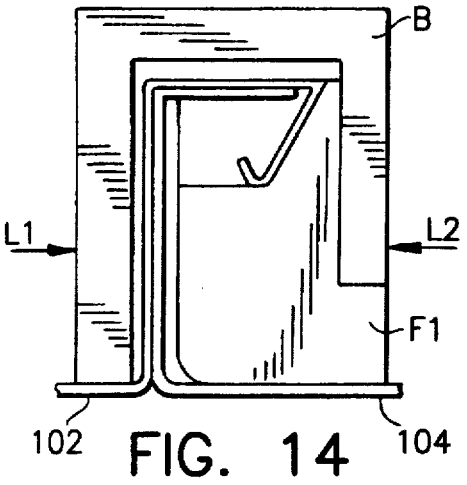
FIGS. 14–19 are end views of an alternative embodiment of the block shown in FIG. 1, preferably employed where the width of the joint is substantially wider than the width of the seam.
Figure 17:
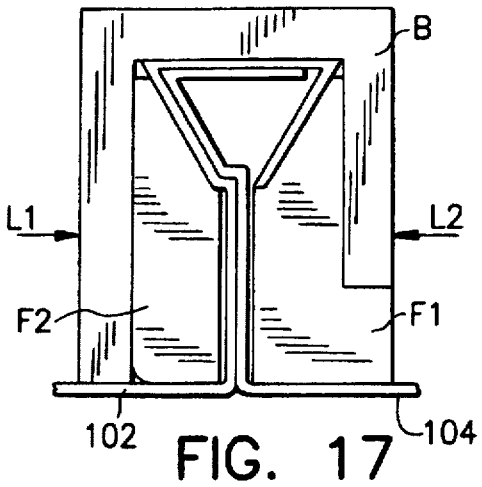
Figure 15:
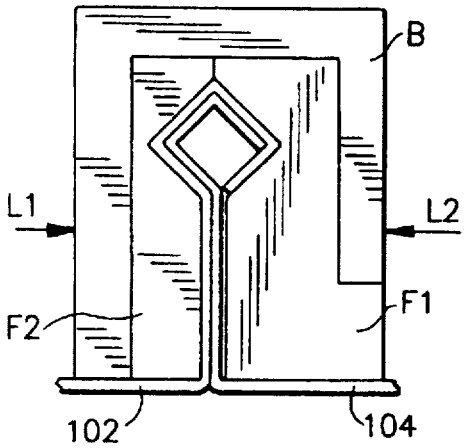
Figure 18:
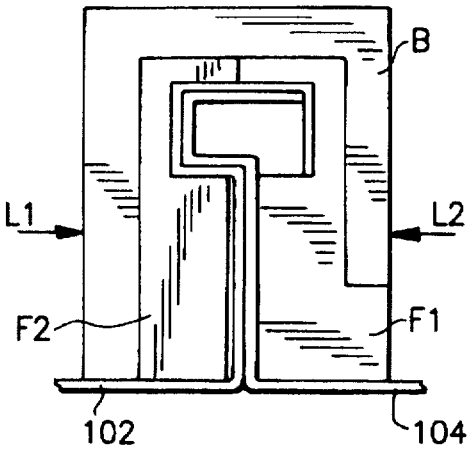
Figure 16:
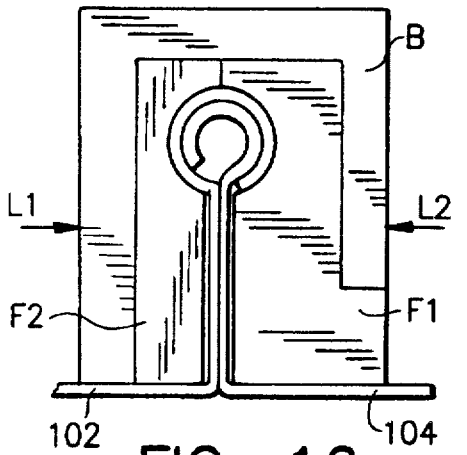

Turning now to FIGS. 14–19, end views of an alternative embodiment of the block is shown, preferably employed where the width of the joint is substantially wider than the width of the seam.

Where the cross-sectional design of the joint is located to one side of the seam, such as the design of the joint shown in FIG. 14, filler F1 is preferably located in the groove of block B between the seam and the corresponding side wall of the block.

Where the cross-sectional design of the joint is located on both sides of the seam, such as the design of the joints shown in FIGS. 15–18, fillers F1 and F2 are preferably located in the groove of block B, each located between one side of the seam and the corresponding side wall of the block.

Figure 19:
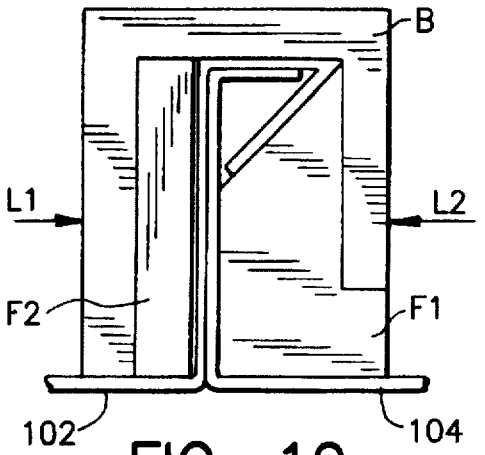

FIG. 19 illustrates an alternative embodiment where the cross-sectional design of the joint is located to one side of the seam. Specifically, filler F2 could be located in the groove of the block to occupy the void, if any, between the left side of the seam and the interior left side wall of the block Fillers F1 and F2 of FIGS. 14–19 are preferably shaped such that the segment of the filler which is in close proximity to the joint is a substantial counterpart to the design of the joint thereat In FIGS. 14–19, block B is preferably secured to the seam of the metal roof via four set screw/ball bearing configurations patterned as shown with reference to FIG. 8. Two set screw/ball bearing configurations are preferably located on each side of the block, at the location shown by arrows L1 and L2. Any other number of set screw/ball bearing configurations may be employed, preferably at least one configuration per side.

In FIGS. 14–19, the block preferably comprises a plurality of cavities (not shown), located along the interior wall thereof diametric to the location of the plurality of set screw/ball bearing configurations, respectively. The block also preferably comprises a groove (not shown) located in the top thereof, to allow a bracket (e.g., 116, FIG. 1) to be secured thereto.

In addition to mounting the present invention on the seam of a metal roof, it is also desirable to mount the present invention on other types of roofs which do not have seams, such as a slate roof, a shingled roof and a rubber or membrane roof.

Figure 20:
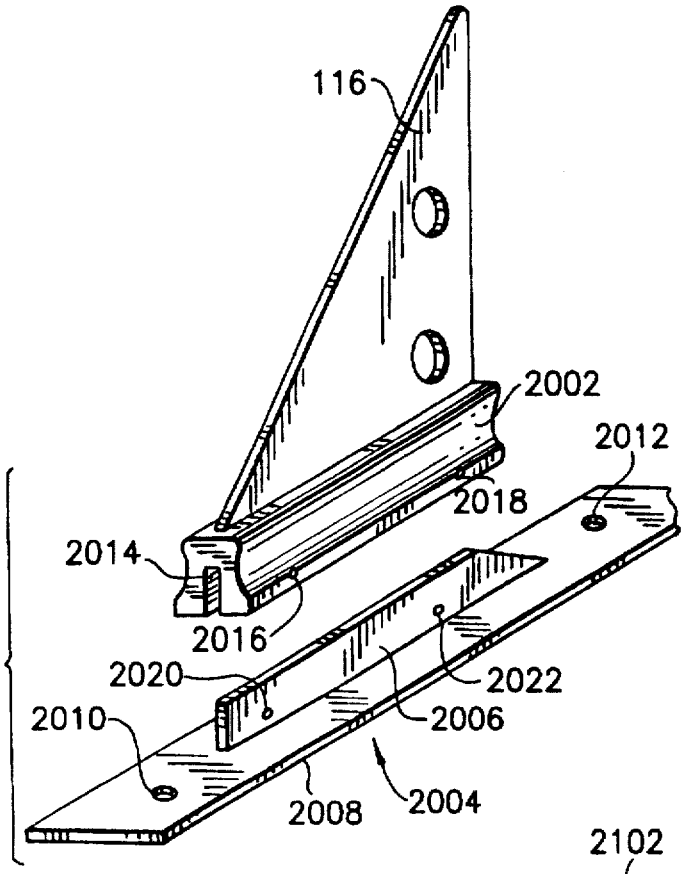
FIG. 20 is an alternative embodiment of the present invention shown in FIG. 1.

Turning now to FIG. 20, an alternative embodiment of the present invention is shown for use with a slate, shingled, tarred or other types of roofs which do not have seams. In place of the seam of a metal roof, block 2002 is mountable on mounting bracket 2004, preferably comprising plate 2006 mounted substantially perpendicular to plate 2008. Plate 2006 can be welded to plate 2008. In the preferred embodiment, plate 2006 is integral with plate 2008.

The mounting bracket is securable to a roof via two screws (not shown) placed through holes 2010 and 2012, respectively, preferably into a wooden subroof and more preferably into a wooden rafter supporting the subroof.

Block 2002 is securable to mounting bracket 2004 via placing groove 2014 over plate 2006, and aligning holes 2016 and 2018 in the block with holes 2020 and 2022, respectively, in the mounting bracket.

Holes 2016, 2018 and/or 2020, 2022 can be threaded to receive screws therethrough, thereby securely mounting the block to the mounting bracket. Alternatively, pins, cotter pins and/or bolts may be used to securely mount the block to the mounting bracket.

Figure 21:
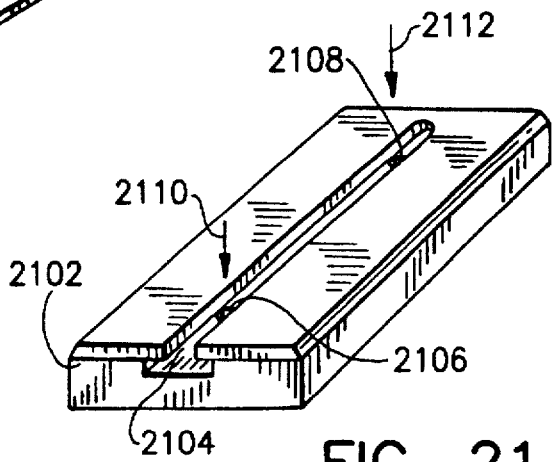
FIG. 21 is another alternative embodiment of the present invention shown in FIG. 1.

Turning now to FIG. 21, another alternative embodiment of the present invention is shown. Block 2102 preferably comprising groove 2104 into which a bracket (e.g., 116, FIG. 1) can be located.

Block 2102 is preferably securable to a roof via two screw (not shown) placed through holes 2106 and 2108, at the location shown by arrows 2110 and 2112, respectively, preferably into a wooden subroof and more preferably into a wooden rafter supporting the subroof.

Figure 22:
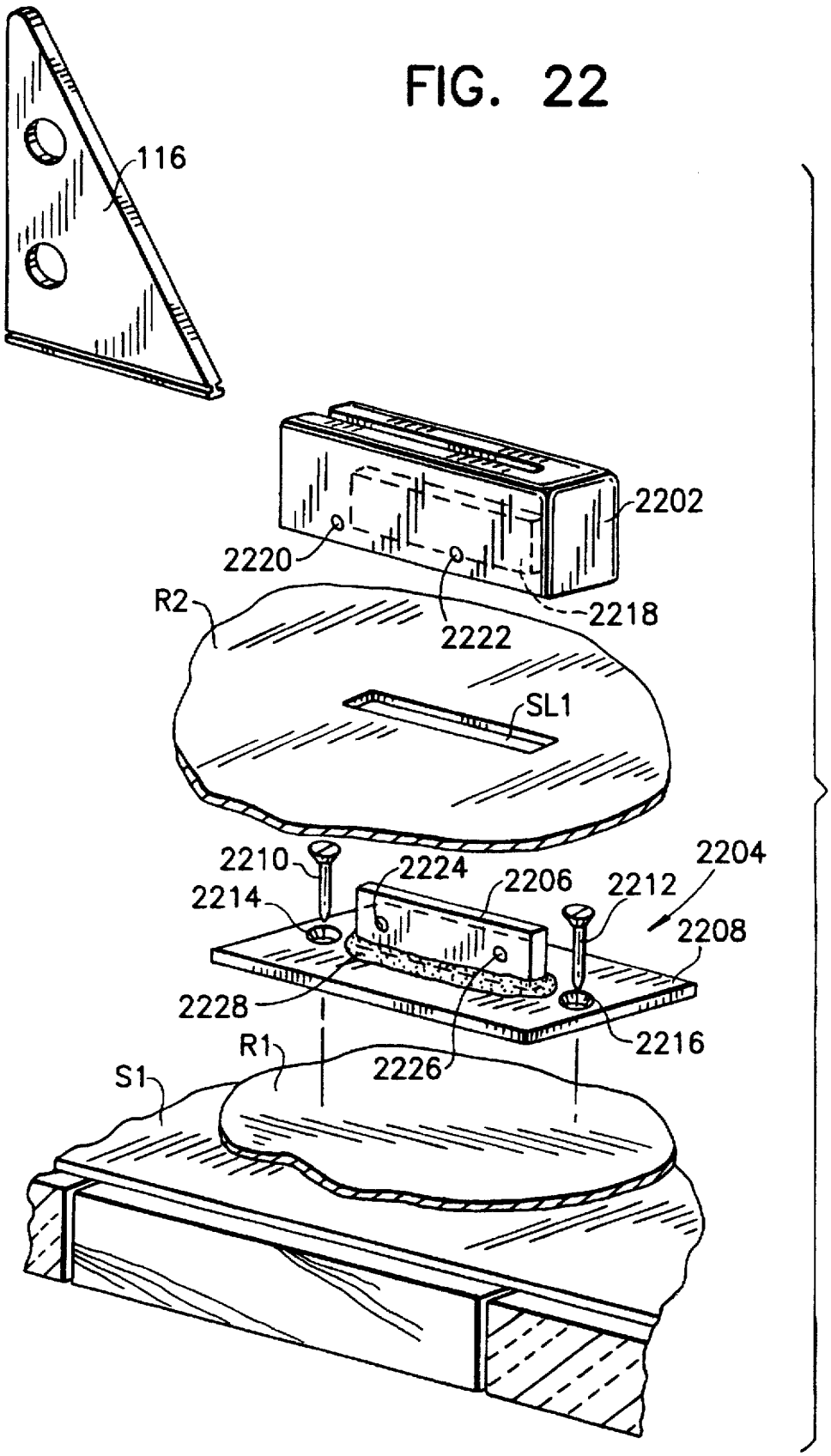
FIG. 22 is another alternative embodiment of the present invention shown in FIG. 1.

Turning now to FIG. 22, another alternative embodiment of the present invention shown for use with a rubber or membrane roof. Block 2202 is mountable on mounting bracket 2204, preferably comprising plate 2206 mounted substantially perpendicular to plate 2208. Plate 2206 can be welded to plate 2208. In the preferred embodiment, plate 2206 is integral with plate 2208.

The rubber roof typically comprises a first rubber pad, or substrate, R1, mounted over wooden subroof S1, as well as a second rubber pad, or substrate, R2, mounted thereover.

In the preferred embodiment, mounting bracket 2204 is securable to the roof via screws 2210 and 2212 placed through holes 2214 and 2216, respectively, preferably through rubber pad R1 and into wooden subroof S1, and more preferably into a wooded rafter (not shown) supporting the subroof.

Mounting bracket 2204 is preferably located under the top-most rubber pad, R2, and over all lower roofing pads and substrates, e.g., first rubber pad R1 and wooden subroof S1. The top-most rubber pad, R2, preferably has slot SL1 cut therethrough to accommodate plate 2206.

Block 2202 is preferably securable to the mounting bracket via placing groove, or cut-out, 2218 over plate 2206, and aligning holes 2220 and 2222 in the block with holes 2224 and 2226, respectively, in the mounting bracket.

In the preferred embodiment, gasket 2228 is placed about the intersection of plates 2206 and 2208 to create a seal between slot SL1 in rubber pad R2 and mounting bracket 2204.

Additionally, when block 2202 is placed over plate 2206, holes 2220 and 2222 in the block are preferably slightly above holes 2224 and 2226, respectively, in the mounting bracket.

To align the holes, a downward force is preferably exerted on the top of block 2202, forcing the base of the block into the surface of rubber pad R2, thereby forming a seal therebetween. In the preferred embodiment, if the thickness of rubber pad R2 is x, holes 2220 and 2222 are offset from holes 2224 and 2226, respectively, about 0.3x.

Holes 2220, 2022 and/or 2024, 2226 can be threaded to receive screws therethrough, thereby securely mounting the block to the mounting bracket. Alternatively, pins, cotter pins and/or bolts may be used to securely mount the block to the mounting bracket.

In the preferred embodiments discussed hereinabove, aluminum is the preferred material for the blocks, fillers, brackets and mounting brackets. However, other materials, e.g., steel, stainless steel, high-impact plastic, may also be employed.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What I claim as my invention is:

1. A device capable of being attached to a metal roof having a first roofing panel and a second roofing panel, the first and second roofing panels each having a bend therein located along a longitudinal axis thereof, the bend forming a substantially perpendicular longitudinal portion terminating at a first terminal end and a second terminal end, respectively, the longitudinal portion of the first roofing panel positioned in close proximity to the longitudinal portion of the second roofing panel forming a substantially perpendicular longitudinal seam, the first terminal end of the first roofing panel wrapped about the second terminal end of the second roofing panel forming a longitudinal joint, said device comprising:

a block having a first and a second side wall, a base and a top;

a groove located in the base of the block, wherein the block is locatable on the metal roof by placement of the groove over a segment of the longitudinal joint and a corresponding segment of the longitudinal seam;

a filler having a first and a second side wall, a base and a top, the filler locatable in the groove of the block between the segment of the longitudinal seam and the second side wall of the block such that the first side wall of the filler is in proximity to the segment of the longitudinal seam and the second side wall of the filler is in proximity to the second side wall of the block;

a first threaded hole located in the block between the first side wall of the block and the groove;

a first cavity located in the first side wall of the filler, the first cavity positionable diametrical to the first threaded hole;

a first element having a substantially curved surface;

a first set screw translocatable within the first threaded hole, the first set screw having a first terminal end in juxtaposition with the first element such that the curved surface of the first element is diametrical thereto and is pivotable thereabout, the first set screw further having a second terminal end drivable into the first threaded hole, wherein driving the first set screw into the first threaded hole causes the substantially curved surface of the first element to engage a first portion of the seam of the metal roof, thereby precluding any rotational movement of the curved surface of the first element, relative to the first engaged portion of the seam, thus causing the first set screw to pivot about the curved surface of the first element, and wherein further driving of the first set screw causes the first engaged portion of the seam to be driven towards the first cavity locatable in the first side wall of the filler diametric thereto, thereby forming a pocket in the first engaged portion of the seam;

a second threaded hole located in the block between the second side wall of the block and the groove;

a third threaded hole located in the filler between the first side wall of the filler and the second side wall of the filler, the second threaded hole located in the block being positionable in line with the third threaded hole located in the filler;

a second cavity located in the groove, the second cavity positionable diametrical to the second and third threaded holes;

a second element having a substantially curved surface; and a second set screw translocatable within the second and third threaded holes, the second set screw having a first terminal end in juxtaposition with the second element such that the curved surface of the second element is diametrical thereto and is pivotable thereabout, the second set screw further having a second terminal end drivable into the second and third threaded holes, wherein driving the second set screw into the second and third threaded holes causes the substantially curved surface of the second element to engage a second portion of the seam of the metal roof, thereby precluding any rotational movement of the curved surface of the second element, relative to the second engaged portion of the seam, thus causing the second set screw to pivot about the curved surface of the second element, and wherein further driving of the second set screw causes the second engaged portion of the seam to be driven towards the second cavity locatable in the groove diametric thereto, thereby forming a pocket in the second engaged portion of the seam.

2. The device of claim 1, said device further comprising:

a fourth threaded hole located in the block between the first side wall of the block and the groove;

a third cavity located in the first side wall of the filler, the third cavity positionable diametrical to the fourth threaded hole;

a third element having a substantially curved surface; and a third set screw translocatable within the fourth threaded hole, the third set screw having a first terminal end in juxtaposition with the third element such that the curved surface of the third element is diametrical thereto and is pivotable thereabout, the third set screw further having a second terminal end drivable into the fourth threaded hole, wherein driving the third set screw into the fourth threaded hole causes the substantially curved surface of the third element to engage a third portion of the seam of the metal roof, thereby precluding any rotational movement of the curved surface of the third element, relative to the third engaged portion of the seam, thus causing the fourth set screw to pivot about the curved surface of the third element, and wherein further driving of the third set screw causes the third engaged portion of the seam to be driven towards the third cavity locatable in the first side wall of the filler diametric thereto, thereby forming a pocket in the third engaged portion of the seam.

3. The device of claim 1, said device further comprising:

a fourth threaded hole located in the block between the second side wall of the block and the groove;

a fifth threaded hole located in the filler between the first side wall of the filler and the second side wall of the filler, the fourth threaded hole located in the block being positionable in line with the fifth threaded hole located in the filler;

a third cavity located in the groove, the third cavity positionable diametrical to the fourth and fifth threaded holes;

a third element having a substantially curved surface; and a third set screw translocatable within the fourth and fifth threaded holes, the third set screw having a first terminal end in juxtaposition with the third element such that the curved surface of the third element is diametrical thereto and is pivotable thereabout, the third set screw further having a second terminal end drivable into the fourth and fifth threaded holes, wherein driving the third set screw into the fourth and fifth threaded holes causes the substantially curved surface of the third element to engage a third portion of the seam of the metal roof, thereby precluding any rotational movement of the curved surface of the third element, relative to the third engaged portion of the seam, thus causing the third set screw to pivot about the curved surface of the third element, and wherein further driving of the third set screw causes the third engaged portion of the seam to be driven towards the third cavity locatable in the groove diametric thereto, thereby forming a pocket in the third engaged portion of the seam.

4. The device of claim 1, wherein:

a portion of a cross-section of the segment of the longitudinal joint is defined by a first geometric design; and a portion of a cross-section of the top of the filler is defined by a second geometric design, the second geometric design being a substantial counterpart to the first geometric design, wherein the filler is locatable in the groove of the block between the segment of the longitudinal seam and the second side wall of the block such that the portion of the top of the filler having the second geometric design is in proximity to the portion of the segment of the longitudinal joint having the first geometric design.

5. A device capable of being attached to a metal roof having a first roofing panel and a second roofing panel, the first and second roofing panels each having a bend therein located along a longitudinal axis thereof, the bend forming a substantially perpendicular longitudinal portion terminating at a first terminal end and a second terminal end, respectively, the longitudinal portion of the first roofing panel positioned in close proximity to the longitudinal portion of the second roofing panel forming a substantially perpendicular longitudinal seam, the first terminal end of the first roofing panel wrapped about the second terminal end of the second roofing panel forming a longitudinal joint, said device comprising:

a block having a first and a second side wall, a base and a top;

a groove located in the base of the block, wherein the block is locatable on the metal roof by placement of the groove over a segment of the longitudinal joint and a corresponding segment of the longitudinal seam;

a first filler having a first and a second side wall, a base and a top, the first filler locatable in the groove of the block between the segment of the longitudinal seam and the first side wall of the block such that the first side wall of the first filler is in proximity to the segment of the longitudinal seam and the second side wall of the first filler is in proximity to the first side wall of the block;

a second filler having a first and a second side wall, a base and a top, the second filler locatable in the groove of the block between the segment of the longitudinal seam and the second side wall of the block such that the first side wall of the second filler is in proximity to the segment of the longitudinal seam and the second side wall of the second filler is in proximity to the second side wall of the block;

a first threaded hole located in the block between the first side wall of the block and the groove;

a second threaded hole located in the first filler between the first and second side walls of the first filler, the first threaded hole located in the block being positionable in line with the second threaded hole located in the first filler;

a first cavity located in the first side wall of the second filler, the first cavity positionable diametrical to the first and second threaded holes;

a first element having a substantially curved surface;

a first set screw translocatable within the first and second threaded holes, the first set screw having a first terminal end in juxtaposition with the first element such that the curved surface of the first element is diametrical thereto and is pivotable thereabout, the first set screw further having a second terminal end drivable into the first and second threaded holes, wherein driving the first set screw into the first and second threaded holes causes the substantially curved surface of the first element to engage a first portion of the seam of the metal roof, thereby precluding any rotational movement of the curved surface of the first element, relative to the first engaged portion of the seam, thus causing the first set screw to pivot about the curved surface of the first element, and wherein further driving of the first set screw causes the first engaged portion of the seam to be driven towards the first cavity locatable in the first side wall of the second filler diametric thereto, thereby forming a pocket in the first engaged portion of the seam;

a third threaded hole located in the block between the second side wall of the block and the groove;

a fourth threaded hole located in the second filler between the first and second side walls of the second filler, the third threaded hole located in the block being positionable in line with the fourth threaded hole located in the second filler;

a second cavity located in the groove, the second cavity positionable diametrical to the third and fourth threaded holes;

a second element having a substantially curved surface; and a second set screw translocatable within the third and fourth threaded holes, the second set screw having a first terminal end in juxtaposition with the second element such that the curved surface of the second element is diametrical thereto and is pivotable thereabout, the second set screw further having a second terminal end drivable into the third and fourth threaded holes, wherein driving the second set screw into the third and fourth threaded holes causes the substantially curved surface of the second element to engage a second portion of the seam of the metal roof, thereby precluding any rotational movement of the curved surface of the second element, relative to the second engaged portion of the seam, thus causing the second set screw to pivot about the curved surface of the second element, and wherein further driving of the second set screw causes the second engaged portion of the seam to be driven towards the second cavity locatable in the first filler diametric thereto, thereby forming a pocket in the second engaged portion of the seam.

6. The device of claim 5, said device further comprising:

a fifth threaded hole located in the block between the first side wall of the block and the groove;

a sixth threaded hole located in the first filler between the first and second side walls of the first filler, the fifth threaded hole located in the block being positionable in line with the sixth threaded hole located in the first filler;

a third cavity located in the first side wall of the second filler, the third cavity positionable diametrical to the fifth and sixth threaded holes;

a third element having a substantially curved surface; and a third set screw translocatable within the fifth and sixth threaded holes, the third set screw having a first terminal end in juxtaposition with the third element such that the curved surface of the first element is diametrical thereto and is pivotable thereabout, the third set screw further having a second terminal end drivable into the fifth and sixth threaded holes, wherein driving the third set screw into the fifth and sixth threaded holes causes the substantially curved surface of the third element to engage a third portion of the seam of the metal roof, thereby precluding any rotational movement of the curved surface of the third element, relative to the third engaged portion of the seam, thus causing the third set screw to pivot about the curved surface of the third element, and wherein further driving of the third set screw causes the third engaged portion of the seam to be driven towards the third cavity locatable in the first side wall of the second filler diametric thereto, thereby forming a pocket in the third engaged portion of the seam.

7. The device of claim 5, said device further comprising:

a fifth threaded hole located in the block between the second side wall of the block and the groove;

a sixth threaded hole located in the second filler between the first and second side walls of the second filler, the fifth threaded hole located in the block being positionable in line with the sixth threaded hole located in the second filler;

a third cavity located in the first side wall of the first filler, the third cavity positionable diametrical to the fifth and sixth threaded holes;

a third element having a substantially curved surface; and a third set screw translocatable within the fifth and sixth threaded holes, the third set screw having a first terminal end in juxtaposition with the third element such that the curved surface of the third element is diametrical thereto and is pivotable thereabout, the third set screw further having a second terminal end drivable into the fifth and sixth threaded holes, wherein driving the second set screw into the fifth and sixth threaded holes causes the substantially curved surface of the third element to engage a third portion of the seam of the metal roof, thereby precluding any rotational movement of the curved surface of the third element, relative to the third engaged portion of the seam, thus causing the third set screw to pivot about the curved surface of the third element, and wherein further driving of the second set screw causes the third engaged portion of the seam to be driven towards the third cavity locatable in the first filler diametric thereto, thereby forming a pocket in the third engaged portion of the seam.

8. The device of claim 5, wherein:

a portion of a cross-section of the segment of the longitudinal joint is defined by a first geometric design; and a portion of a cross-section of the top of the first filler is defined by a second geometric design, the second geometric design being a substantial counterpart to the first geometric design, wherein the first filler is locatable in the groove of the block between the first side wall of the block and the segment of the longitudinal seam such that the portion of the top of the first filler having the second geometric design is in proximity to the portion of the segment of the longitudinal joint having the first geometric design.

9. The device of claim 5, wherein:

a portion of a cross-section of the segment of the longitudinal joint is defined by a first geometric design; and a portion of a cross-section of the top of the second filler is defined by a second geometric design, the second geometric design being a substantial counterpart to the first geometric design, wherein the second filler is locatable in the groove of the block between the second side wall of the block and the segment of the longitudinal seam such that the portion of the top of the second filler having the second geometric design is in proximity to the portion of the segment of the longitudinal joint having the first geometric design.

* * * * *